United States Patent [19]

Inabayashi et al.

[11] 4,093,289

[45] June 6, 1978

[54] ELECTRIC/MANUAL DOOR LOCK OPERATING MECHANISM

[75] Inventors: Akira Inabayashi; Jun Watanabe, both of Hiroshima, Japan

[73] Assignees: Toyo Kogyo Co., Ltd., Hiroshima; Tanaka Instrument Co., Ltd., Yono, both of Japan

[21] Appl. No.: 784,757

[22] Filed: Apr. 5, 1977

[30] Foreign Application Priority Data

Apr. 7, 1976 Japan ..... 51-43683[U]

[51] Int. Cl.[2] ..... E05C 13/04

[52] U.S. Cl. ..... 292/336.3; 292/201; 292/DIG. 62

[58] Field of Search ..... 292/201, 336.3, 341.16, 292/347, DIG. 62

[56] References Cited

U.S. PATENT DOCUMENTS

| | | | |
|---|---|---|---|
| 3,243,216 | 3/1966 | Peters | 292/201 |
| 3,566,703 | 3/1971 | Van Noord | 292/201 X |
| 3,751,950 | 8/1973 | Leger et al. | 292/201 X |
| 3,988,859 | 11/1976 | Peterson | 292/201 X |

*Primary Examiner*—Richard E. Moore

*Attorney, Agent, or Firm*—Sughrue, Rothwell, Mion, Zinn and Macpeak

[57] ABSTRACT

A vehicle door lock operating mechanism wherein a reversible electric motor 6 drives a pivotally mounted sector gear 10 through a centrifugal clutch 7 and reduction gears 8, 9 and 32. The sector gear is coupled to the pivotal actuating lever 2 of a lock mechanism 1 by means (ex. slot 13 and guide pin 14) which permit the free travel or play of the actuating lever over a distance equal to its stroke between the locked and unlocked positions. A manual operating knob 3 is also coupled to the lever 2, and a spring 15 biases the sector gear 10 back into a neutral or middle position whenever the motor 6 is deenergized, whereby low force manual operation may be performed independently of the sector gear and reduction gears. The centrifugal clutch, when disengaged in response to the motor deenergization, enables the spring 15 to easily drive the sector gear back into its neutral position.

13 Claims, 11 Drawing Figures

ELECTRIC/MANUAL DOOR LOCK OPERATING MECHANISM

BACKGROUND OF THE INVENTION

This invention relates to an electric, remotely controlled, lock operating mechanism for a vehicle door, including alternate manual operating means.

There are two basic types of door lock operating mechanisms, one of which includes a solenoid drive and the other of which includes an electric motor drive. The former is unduly large, costly and noisy, whereby the latter has been more widely adopted in recent years.

In the latter type of mechanism, installation in a limited space (within a door frame) is enabled by using a small, compact motor coupled to a high ratio reduction gear mechanism. However, if alternate manual operation must be provided, as for safety consideration with vechile door locks, the operator must exert considerable effort since he must "spin up" both the reduction gears and the motor. To avoid this drawback a large motor and low ratio reduction gear mechanism can be used, but then the limited installation space presents a problem.

To obviate these drawbacks, according to Japanese patent publication No. 50-16048 a centrifugal clutch is employed which automatically disengages the drive train when the motor is deenergized, whereby manual operation may be achieved with reduced effort. The force required is still relatively large, however, since the manual control lever is connected to and must drive the high ratio reduction gear mechanism. Further, if the door is mistakenly locked by the manual control lever when the door is open, the lock is automatically released when the door is closed. During such release, however, the reduction gear mechanism is rotated at a relatively high speed, which often causes damage to or failure of the gear mechanism.

To obviate these drawbacks, according to Japanese patent publication No. 48-40275 as shown in FIG. 11, a manual door lock knob 100 is provided with a pawl 101 movable between an upper stop 102*a* and a lower stop 102*b* of a slide member 102. The distance between the stops is substantially equal to the stroke of the knob 100. The slide member 102 is guided in a groove 103 and is connected to the output shaft 104 of a reduction geared motor, whereby the member 102 slides on the groove 103 in response to the rotation of the motor to automatically lock or unlock the door. With this structure, the movement of the knob during manual operation is not transmitted to the reduction gear or motor as long as the slide member 102 is maintained at a neutral position between its door lock and door unlock positions. However, it is necessary to provide a mechanism for stopping the rotation of the motor when the slide member 102 is at its neutral position, and such mechanism is mechanically complicated and costly.

SUMMARY OF THE INVENTION

The above-mentioned drawbacks and disadvantages of the prior art systems are effectively overcome by the present invention, according to which the connecting linkage between the reduction gear mechanism and the manual control lever incorporates a certain degree of play or lost motion whose length is equal to the stroke of the manual control lever, whereby the movement of the latter is not transmitted to the reduction gear mechanism and a motor. Thus, manual operation is greatly facilitated and damage to the reduction gear mechanism is prevented. Further, according to the present invention a simple spring is employed to restore the neutral position of the reduction gear mechanism, whereby no complicated drive motor control is necessary and a structurally simple device is achieved.

DETAILED DESCRIPTION OF THE PREFERRED EMBODIMENTS

Figure 1:
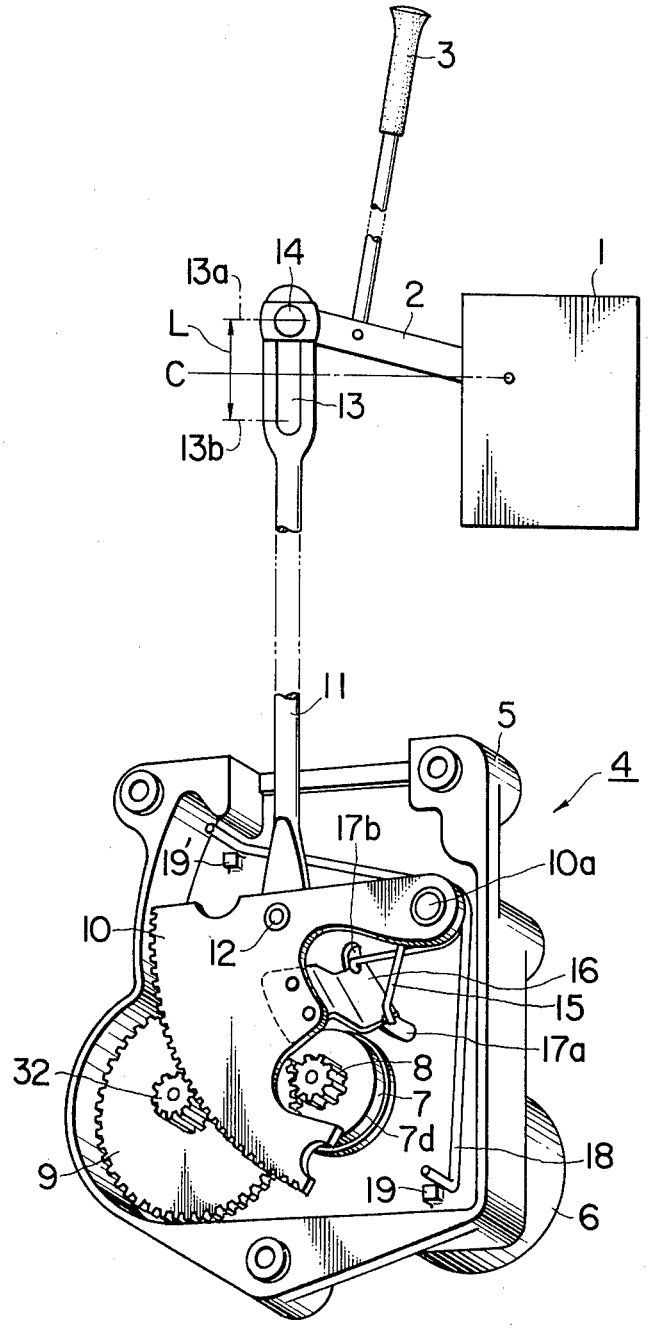
FIG. 1 shows a perspective view, partly cutaway, of one embodiment according to the present invention.

In FIG. 1, door locking and unlocking is implemented by a lock mechanism 1 in response to the pivotal movement of a lever 2 mounted on the mechanism. A knob 3 is pivotally mounted to the lever 2 to manually operate it up and down. Reference numeral 4 designates an electrical door lock operating mechanism. For simplicity of explanation the mechanism cover has been removed in FIG. 1. A motor 6 is disposed below a casing 5, and an output shaft of the motor extends into the casing. A centrifugal clutch 7 is mounted on the output shaft.

Figure 2:
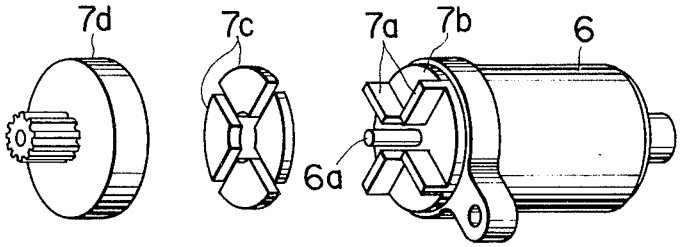
FIGS. 2 and 3 show exploded views of alternate centrifugal clutch mechanisms according to the invention.

As seen in FIG. 2, the centrifugal clutch mechanism 7 includes a rotatable disc 7*b* secured to the motor shaft 6*a* and four radial partition plates 7*a* mounted on the disc. Sector-shaped weight members 7*c* are slidably accomodated in the quadrant spaces defined by the disc 7*b*, the partition plates 7*a* and a surrounding cylindrical cup member 7*d*. The cup member 7*d* is freely rotatable about the output shaft 6*a* of the motor, and the outer circumference of each weight member centrifugally contacts or separates from the inner periphery of the cup member. When the motor 6 is energized by a switch (not shown) the disc 7*b* together with the four partition plates 7*a* begins to rotate. The weight members 7*c* also rotate, and move radially outwardly to centrifugally engage the inner wall of the cup member 7*d*, to thus rotate the latter.

Figure 3:
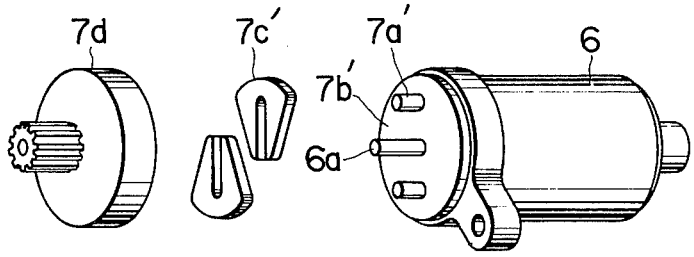

FIG. 3 shows an alternate centrifugal clutch mechanism including a rotatable disc member 7*b*′ secured to the motor shaft 6*a* and a pair of pins 7*a*′ upstanding from the disc. Slots formed in centrifugal weight members 7*c*′ are slidably engaged with the pins 7*a*′ and the output shaft 6*a*. The functioning of the FIG. 3 construction is identical to that of FIG. 2.

Referring again to FIG. 1, a reduction mechanism gear 9 engages a pinion 8 axially secured to the cylindrical cup member 7*d*, and a smaller gear 32 is coaxially mounted on the gear 9. The smaller gear 32 engages a sector gear 10 pivotally mounted on shaft 10*a* fixed to the casing 5. The flattened lower end of an actuating rod 11 is pivotally coupled to the sector gear 10 by a connecting pin 12. The flattened upper end of the rod 11 has an elongaged slot 13 in which a pin 14 secured to the end of the lever 2 is slidingly disposed whereby the lever 2 may be moved up and down by the actuating rod 11. The length of the slot 13 is substantially equal to the length of the stroke L of the pin 14 necessary to actuate the lock mechanism 1 via the lever 2. A torsion spring 15 is disposed around the pivot shaft 10*a* to bias the sector gear 10 toward a neutral position, as shown in FIG. 1. The ends of the spring 15 are freely engaged with the sides of a plate member 16 fixed to the sector gear 10, and extend into a pair of holes or slots 17*a*, 17*b*. When the sector gear 10 is in a neutral position the center of the slot 13 is positioned at a level C, which bisects the stroke L of the lever 2. The pin 14 is positioned at the upper end 13*a* of the slot 13 when the door is unlocked, and at the lower end 13*b* of the slot 13 when the door is locked.

When the motor 6 is deenergized after forward or reverse rotation, the sector gear 10 is restored to its neutral position by the biasing force of the torsion spring 15. A second torsion spring 18 is disposed around the pivot shaft 10*a* and its protruding ends engage posts 19, 19' at the corners of the casing 5. The spring 18 functions as a damper, whereby the sector gear 10 engages the upstanding ends of the spring to widen it and thus decrease the striking force of the sector gear against the casing 5. Rubber dampers may also be substituted for the spring 18.

With this structure, when the door is unlocked, the operator can manually lock it by simply pushing down on the knob 3 and with it the lever 2, whereby the pin 14 moves from the upper end 13*a* of the longitudinal slot to the lower end 13*b* thereof. The operator can also manually unlock the door by pulling up on the knob 3 and lever 2, whereby the pin 14 travels from the lower end 13*b* of the slot 13 to the upper end 13*a* thereof. In both cases, since the pin 14 moves only between the upper and lower ends of the slot 13, i.e., over the distance L, the movement of the lever 2 is not transmitted to the actuating rod 11, whereby manual operation is not coupled to and does not drive the reduction gear mechanism.

Figure 4:
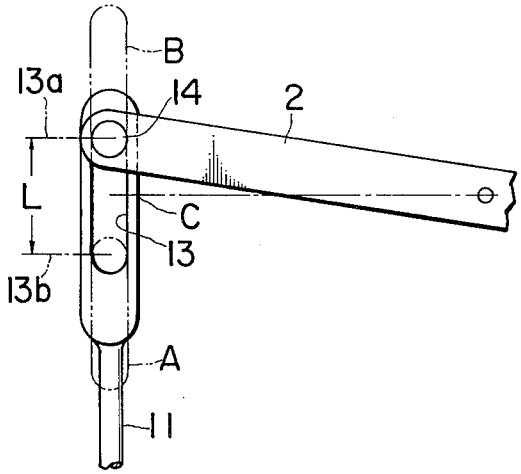
FIG. 4 shows a partial front view of the connecting linkage of FIG. 1.

In automatic operation, in order to lock the unlocked door the motor shaft 6*a* is driven counterclockwise (ccw) to centrifugally engage the weight members 7*c* with the inner wall of the cup member 7*d*, whereby the sector gear 10 is pivoted downwardly or ccw from its neutral position through the reduction gear 9. This pulls down the actuating rod 11, the pin 14 which engages the upper end 13*a* of the slot 13, as shown at position A in FIG. 4, and with it the lever 2. One end of the torsion spring 15 engages the lower end of the hole 17*b*, while the other end of the spring is moved along the hole 17*a* by reason of its engagement with the plate member 16. Upon completion of the door locking the edge of the sector gear 10 is in contact with the side wall of the casing 5, which prevents the sector gear from further rotation. When the motor 6 is deenergized the sector gear is restored to its neutral position by the torsion spring 15, to thereby raise the slot 13 of the actuating rod 11 to its neutral position (as shown by the solid lines in FIG. 4), whereat the pin 14 contacts the lower end 13*b* of the slot. Owing to the disengagement of the centrifugal clutch 7, the motor 6 is not rotated during the movement of the sector gear 10 to its neutral position, whereby such movement is easily and rapidly accomplished by the biasing force of the spring 15.

On the other hand, in order to unlock the locked door, the motor is driven clockwise (cw) to pivot the sector gear 10 upwardly or cw through the clutch and reduction gear mechanism, to thereby move the actuating rod 11 upwardly. When the door is unlocked the slot 13 is in the position shown at B in FIG. 4. When the motor 6 is deenergized, the centrifugal clutch is disengaged and the sector gear 10 is biased back to its neutral position by the torsion spring 15, which moves the slot 13 to the neutral position at which the pin 14 contacts the upper end 13*a* of the slot.

Any impact that occurs when the sector gear 10 strikes the casing 5 is absorbed by frictional slippage in the clutch 7. Since the distance moved by the actuating rod 11 due to the movement of the sector gear 10 is equal to the stroke L between the door lock and unlock positions, the stroke of the gear 10 is determined to be substantially equal to the length L from the neutral position thereof to either the downward or upward limit of travel. For manufacturing purposes, however, the sector gear swing is designed to be somewhat larger than the stroke L.

Figure 5:
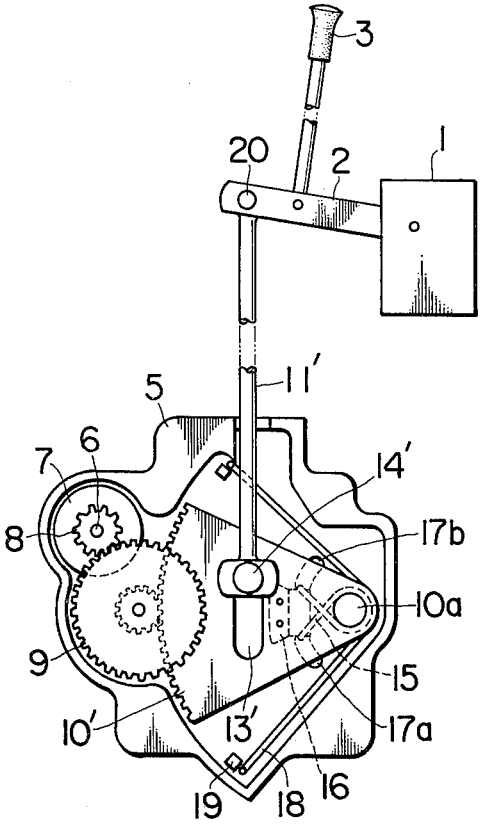
FIG. 5 shows a front view of another embodiment according to the present invention.

FIG. 5 shows another embodiment of the invention, wherein the reference numerals designate the same structural elements shown in FIG. 1. Instead of providing an elongated slot 13 at the upper end of the actuating rod 11 as shown in FIG. 1, however, in FIG. 5 an elongated slot 13' is provided in the sector gear 10'. The upper end of the actuating rod 11' is thus pivotally connected to the lever 2 by a pin 20, while the lower end thereof is provided with a pin 14' which is slidably disposed in the slot 13'. The remaining structure and operation is identical to that of FIG. 1, except for the relocation of the motor 6 and reduction gear 9.

In the above two embodiments the elongated slot is positioned either in the upper end of the actuating rod 11 or in the sector gear 10'. Alternatively, the slot may be positioned in the lower end of the actuating rod, or directly in the lever 2. That is, the slot may be disposed at any place in the connecting linkage between the lever 2 and the sector gear 10.

Figure 6:
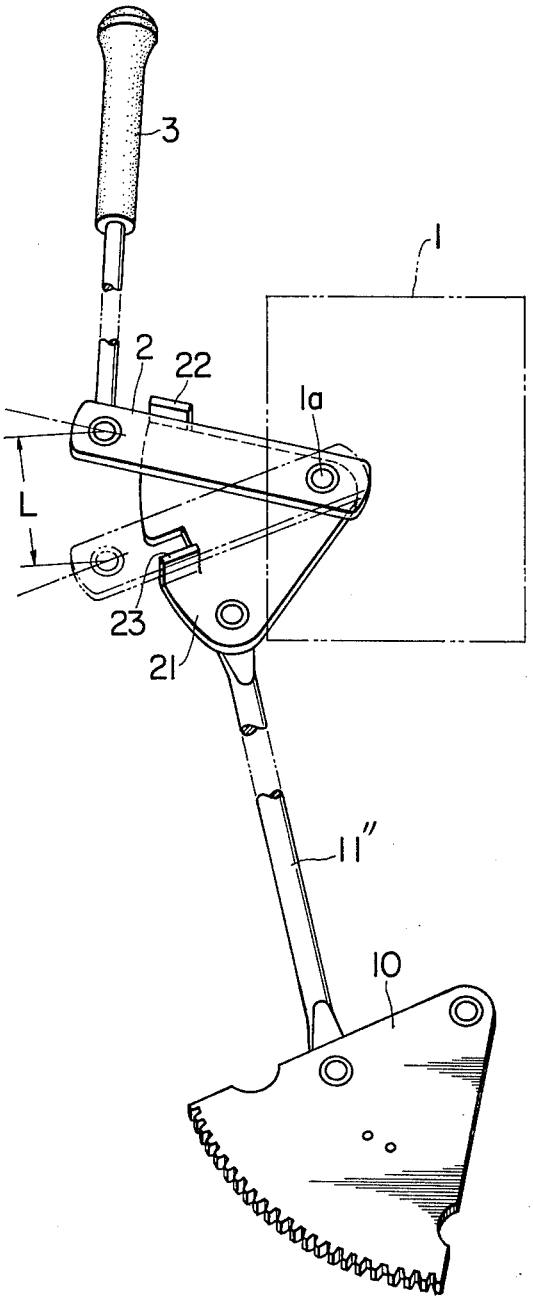
FIG. 6 shows a perspective view of still another embodiment according to the present invention.

FIG. 6 shows another embodiment of the invention, wherein one end of the lever 2 is pivotally mounted to the lock mechanism 1 by a shaft 1*a*, and the other end of the lever 2 is connected to a manual operating knob 3. A sector-shaped linkage member 21 is also pivotally mounted on the shaft 1*a*, and an actuating rod 11'' is pivotally connected thereto. An upper stop projection 22 and a lower stop projection 23 are provided on the linkage member 21, the distance between them being substantially equal to the stroke L of the lever 2 beteen the lock and unlock positions, whereby the lever 2 may slide between the upper and lower projections 22, 23. The structure and functioning of this embodiment is otherwise identical to that of the former embodiments. Alternatively, the manual knob 3 may be connected to the sector-shaped linkage member 21, and the actuating rod 11 connected to the lever 2.

Figure 7:
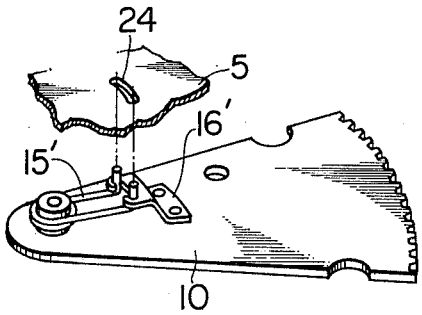
FIGS. 7 and 8 show perspective views of other spring arrangements according to the present invention.
Figure 8:
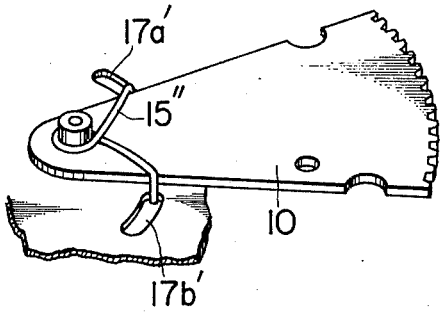

FIGS. 7 and 8 show other embodiments of the torsion spring 15 for biasing the sector gear 10 to its neutral position. In FIG. 7 a torsion spring 15' is disposed around the bearing of the pivot shaft 10*a*, and the upstanding ends of the spring 15' are inserted in an elongated hole 24. The widening of the spring 15' is prevented by a plate 16' attached to the sector gear 10. In this case, only a single hole is required as opposed to the two holes 17*a*, 17*b* in the embodiment of FIG. 1. In FIG. 8 a torsion spring 15'' straddles the sector gear 10, and its ends are inserted in the holes 17*a'* and 17*b'*. With this arrangement the plate 16 and 16' is not required.

Figure 9:
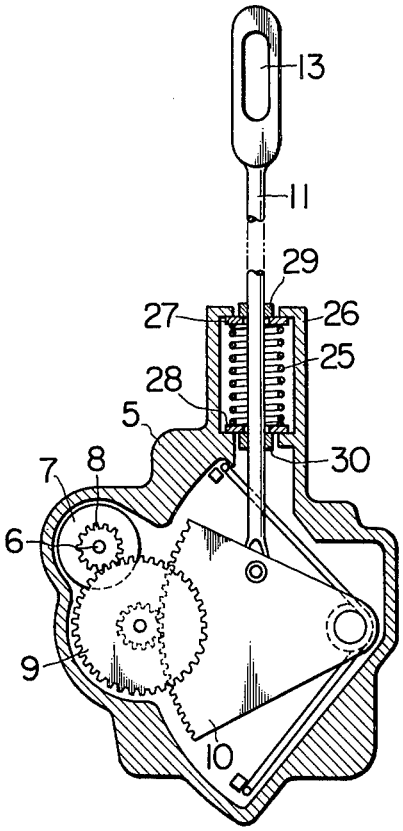
FIG. 9 shows a front view of still another embodiment according to the present invention.
Figure 11:
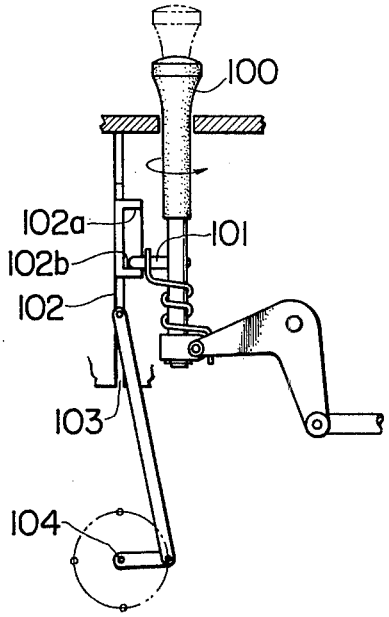
FIG. 11 PRIOR ART
FIG. 11 shows a conventional door lock mechanism according to Japanese patent publication No. 48-40275.

Instead of providing a torsion spring 15, 15', or 15'' as in FIG. 1, FIG. 7, and FIG. 8, respectively, a coil spring 25 may be disposed around the actuating rod 11, as shown in FIG. 9. The spring 25 is disposed in a housing 26 defined in the upper portion of the casing 5, and the upper and lower ends of the housing have openings to accommodate the actuating rod 11. Upper and lower washers 27, 28 having larger diameters than the rod openings are disposed in the housing to compress the spring 25, and upper and lower stops 29, 30 are fixed to the actuating rod just outside of the upper and lower washers 27, 28, respectively. In operation, when the sector gear 10 is moved upwardly by the energization of the motor, the washer 27 is stopped by the upper wall of the spring housing 26 while the washer 28 is moved upwardly by the stop 30 to compress the spring 25. When the motor is deenergized, the sector gear 10 is pivoted back to its neutral position by the restoring force of the spring 25.

Figure 10:
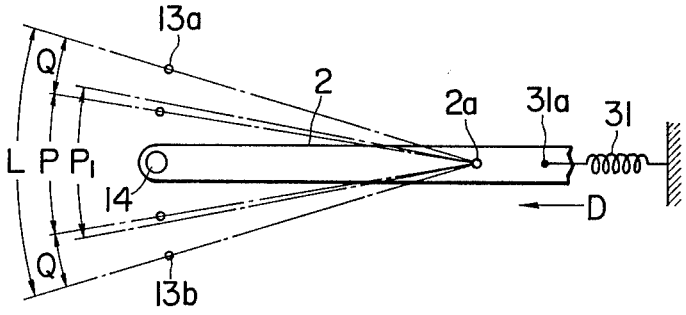
FIG. 10 shows an explanatory view of a spring action according to the present invention.

FIG. 10 shows a supplemental feature of the invention which may be employed with any of the preceding embodiments, according to which a compression spring 31 is attached to the lever 2 at point 31*a*. The biasing force of the spring 31 acts in the direction D as shown in FIG. 10. When the pin 14 on the lever 2, the pivot point 2*a*, and the point 31*a* are in straight alignment, as shown in FIG. 10, no force is exerted on the lever 2 since the spring 31 does not provide any rotational moment about the pivot point 2*a*. If the lever 2 is pivoted slightly up or down by the actuating rod, the biasing force of the spring 31 reinforces the pull of the actuating rod 11, but such additional force is largely negated or offset by the frictional forces generated in the lock mechanism 1 when the lever 2 is within an angular range P. If the lever 2 exceeds the range P, however, due to the movement of the actuating rod 11, its rotation is then automatically continued by the force of the spring 31 within a range designated Q to positively lock or unlock the door. The rotation of the motor shaft can therefore be minimized, and limited to a range designated $P_1$ whereat the spring force becomes sufficiently larger than the frictional resistance of the lock mechanism to sharply complete the locking or unlocking operation.

What is claimed is:

1. A vehicle door lock operating mechanism, comprising:

(a) a door lock mechanism, (b) actuating means connected to said lock mechanism and movable between a locked position and an unlocked position, (c) operating means connected to said actuating means for manually moving same between said locked and unlocked positions, (d) a reversible electric motor, (e) a pivotal member movable between a locking position, an unlocking position, and a neutral position, (f) reduction gear means engageable between said electric motor and said pivotal member for implementing the movement of the latter from its neutral position to either its locking position or its unlocking position by the selective energization of said electric motor, (g) means connecting said actuating means and said pivotal member and including means for permitting a limited degree of free movement of said actuating means independent from said pivotal member when the latter is in its neutral position, whereby the lock mechanism may be manually operated independendly of said motor and reduction gear means, and (h) spring means for biasing said pivotal member towards its neutral position.

2. A door lock operating mechanism as claimed in claim 1, further comprising a centrifugal clutch operatively coupled between said electric motor and said reduction gear means for transmitting the rotary motion of said electric motor to said reduction gear means and for enabling said spring means to bias said pivotal member into its neutral position independently of said electric motor.

3. A door lock operating mechanism as claimed in claim 2, wherein said centrifugal clutch comprises a plurality of weight members freely movable in a radial direction in response to the rotary motion of said electric motor but rotatable together therewith, and a cylindrical member surrounding said weight members, engaged with said reduction gear means, and engageable with said weight members.

4. A door lock operating mechanism as claimed in claim 2, wherein said connecting means includes:

(a) linkage means pivotally coupled to said pivotal member at one end and defining a pair of spaced abutments at the other end, the distance between said abutments being substantially equal to the movement of said actuating means between its locked and unlocked positions, and (b) means for enabling the movement of said actuating means between said abutments.

5. A door lock operating mechanism as claimed in claim 4, wherein the other end of said linkage means comprises an elongated slot, the abutments are defined by the opposite ends of said slot, and the enabling means comprises a member operatively coupled to said actuating means and slidably disposed in said slot.

6. A door lock operating mechanism as claimed in claim 4, wherein the other end of said linkage means comprises a pivotally mounted sector member, the abutments are defined by projection means on said sector member, the enabling means comprises means mounting the actuating means for pivotal movement about the same axis as said sector member, and the actuating means is movably disposed between said projections.

7. A door lock operating mechanism as claimed in claim 2, wherein said connecting means comprises an elongated slot in said actuating means, and linkage means pivotally coupled to said pivotal member at one end and slidably engaging said slot at the other end for relative movement between the ends thereof, the length of said slot being substantially equal to the movement of said actuating means between its locked and unlocked positions.

8. A door lock operating mechanism as claimed in claim 2, wherein said connecting means comprises an elongated slot in said pivotal member, and linkage means pivotally coupled to said actuating means at one end and slidably engaging said slot at the other end for relative movement between the ends thereof, the length of said slot being substantially equal to the movement of said actuating means between its locked and unlocked positions.

9. A door lock operating mechanism as claimed in claim 2, wherein said connecting means comprises linkage means pivotally coupled to said actuating means at one end and having an elongated slot at the other end, and means operatively coupled to said pivotal member and slidably disposed in said slot, the length of said slot being substantially equal to the movement of said actuating means between its locked and unlocked positions.

10. A door lock operating mechanism as claimed in claim 2, wherein said connecting means comprises said actuating means being configured as a pivotally mounted sector member having a pair of spaced projections defined thereon, linkage means pivotally coupled to said pivotal member at one end, a lever member mounted for pivotal movement about the same axis as said sector member and movably disposed between said projections, and means pivotally coupling the other end of said linkage means to said lever member, the distance between said projections being substantially equal to the movement of said actuating means between its locked and unlocked positions.

11. A door lock operating mechanism as claimed in claim 2, wherein said spring means is mounted on said pivotal member.

12. A door lock operating mechanism as claimed in claim 2, wherein said spring means is disposed around said connecting means.

13. A door lock operating mechanism as claimed in claim 2, further comprising supplemental spring means for assisting the movement of said actuating means toward said locked and unlocked positions.

* * * * *